United States Patent [19]

Jailor

[11] Patent Number: 5,071,012

[45] Date of Patent: Dec. 10, 1991

[54] VACUUM CLEANER/EXTRACTOR ACCESSORY CADDY

[75] Inventor: John J. Jailor, Rockford, Mich.

[73] Assignee: Bissell, Inc., Grand Rapids, Mich.

[21] Appl. No.: 694,909

[22] Filed: May 2, 1991

[51] Int. Cl.[5] ..... A47F 5/00

[52] U.S. Cl. ..... 211/13; 211/70.6; 211/87; D6/570

[58] Field of Search ..... 211/13, 70.6, 87, 88, 211/65, 66; D6/570, 571, 573, 574

[56] References Cited

U.S. PATENT DOCUMENTS

D. 222,913 2/1972 Searcy ..... D6/570

D. 247,660 4/1978 Tortorici ..... D6/571 X 3,650,407 3/1972 Benham ..... 211/87 X 4,334,724 6/1982 Rogers ..... 211/87 X

*Primary Examiner*—Robert W. Gibson, Jr.

*Attorney, Agent, or Firm*—Price, Heneveld, Cooper, DeWitt & Litton

[57] ABSTRACT

A wall mountable vacuum accessories caddy has a generally planar front surface with a rearwardly projecting perimeter flange and forwardly projecting arms for releasably receiving and supporting vacuum accessories. In one aspect of the invention, the caddy is a one-piece injection molding, moldable in a simple two-piece mold.

19 Claims, 3 Drawing Sheets

VACUUM CLEANER/EXTRACTOR ACCESSORY CADDY

BACKGROUND OF THE INVENTION

This invention relates to wall mountable holders for vacuum cleaner and extractor accessories.

Vacuum cleaners and extractors typically include a variety of accessories, such as a floor cleaning head, an upholstery cleaning head, a dusting head and a crevice tool for example. Such accessories are commonly difficult to keep organized and can easily become lost or damaged, if not kept in an organized manner. Thus, the need for a convenient accessories organizing aid is readily apparent.

In the past, a caddy for vacuum accessories was commonly folded from a single sheet of diecut paperboard. However, such structures are not generally durable, especially when used with a liquid extractor where liquid can easily come in contact with the paperboard structure, causing rapid deterioration thereof.

Vacuum accessories' caddies have also been known to be made of more durable materials, including plywood, fiberboard, plastic and light sheet metal. However, such devices have typically been more expensive, required a multiplicity of parts to be assembled and have been relatively heavy or cumbersome in use. Such deficiencies will cause disuse of such caddies.

Further developments using plastic materials have also been known. However, such plastic configured accessories, caddies often comprise quite simple hangers with limited utility. Otherwise, more sophisticated and complicated caddies have been known which require assembly of multiple parts. Another option is the expensive use of complicated molds to form a single piece caddy.

SUMMARY OF THE INVENTION

The present invention addresses the above discussed problems with a single piece vacuum and extractor accessories caddy which is moldable in a two-piece mold, has a generally planar face panel which is circumscribed by a perimeter flange extending to one side of the face panel, has a plurality of support arms projecting from the face panel in a direction opposite to the flange for supporting at least one cleaning accessory, has a slot in the face panel segmenting the panel into an upper and a lower panel defining a tray behind the lower panel, and is mountable upon a vertical surface.

These and other objects, advantages and features of the present invention will become apparent upon review of the following specification in conjunction with the drawings.

DESCRIPTION OF THE PREFERRED EMBODIMENT

Figure 1:
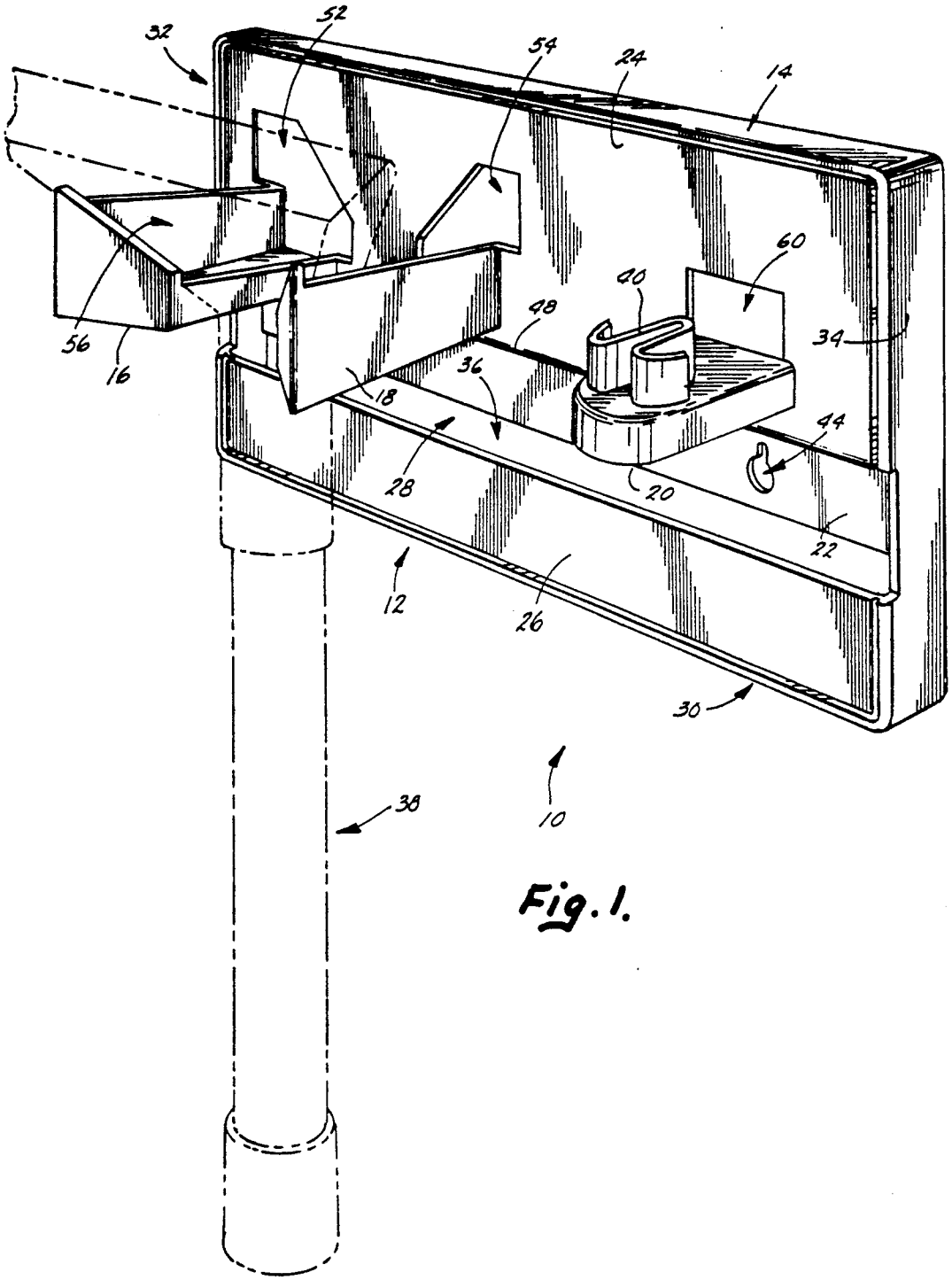
FIG. 1 is a perspective view of a caddy according to the invention with a floor cleaning tool shown in phantom.

In a preferred embodiment, caddy 10 comprises a generally planar face plate 12, having a perimeter flange 14, tool support arms 16, 18 and 20 and mounting plate 22 (FIG. 1).

Figure 2:
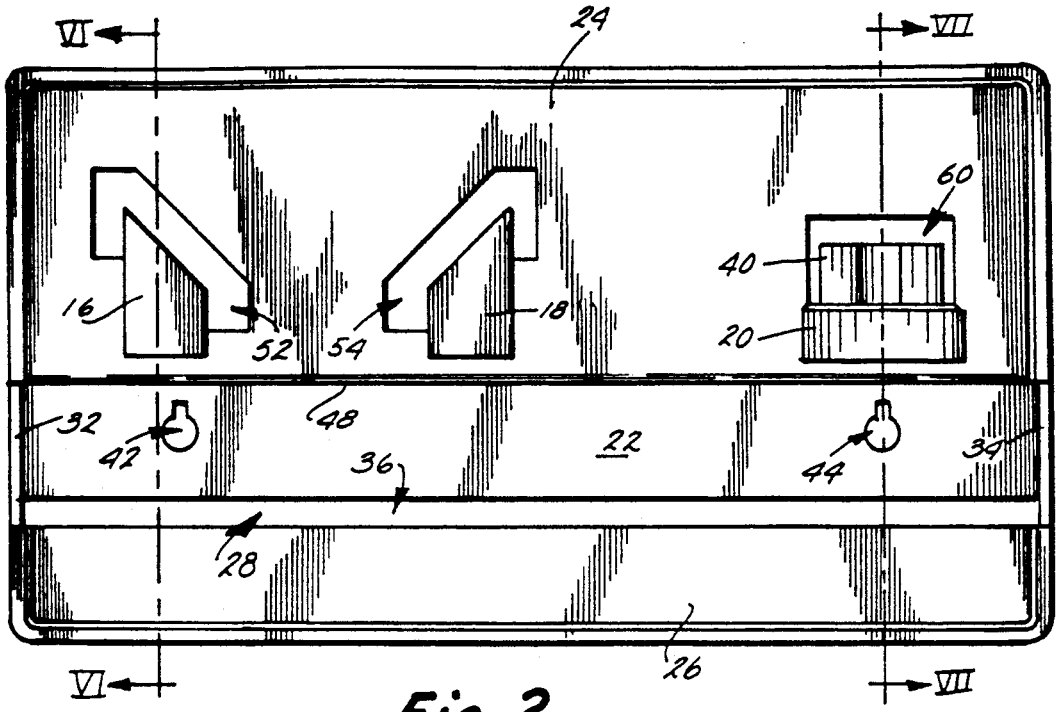
FIG. 2 is a front elevational view of the caddy of FIG. 1.

Face plate 12 is separated into upper plate 24 and lower plate 26 by a slot 28 which extends horizontally across face plate 12 from edge to edge (FIGS. 1 and 2). When mounted to a vertical surface, lower plate 26 acts in combination with the bottom portion 30 and side portions 32 and 34 of perimeter flange 14 to form a tray area 36 for receiving and storing a cleaning tool, such as a crevice tool for example. Yet tray 36 is open in the back so that caddy 10 can be molded in a two-piece mold (FIGS. 4–7). In use, the wall surface to which caddy 10 is secured serves as the back wall for tray 36.

Tool support arms 16, 18 and 20 project forward from upper plate 24 (FIGS. 1 and 3–7). Arms 16 and 18 function as a pair to support a floor cleaning tool 38 (FIG. 1). Arm 20 also projects forward from upper plate 24 and has an upwardly projecting stud 40 for releasably coupling with and supporting a cleaning tool head.

Figure 7:
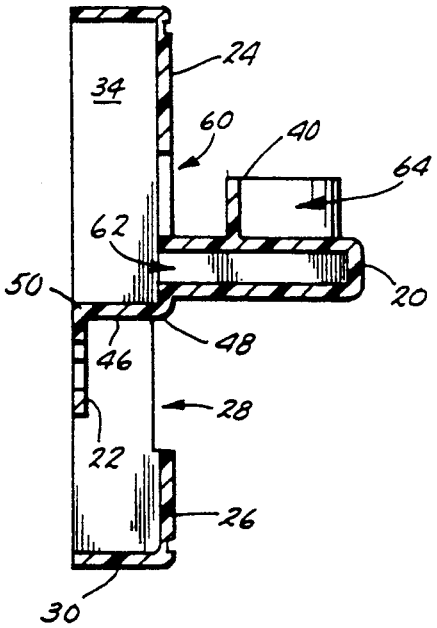
FIG. 7 is a sectional view along section line VII—VII of FIG. 2.
Figure 6:
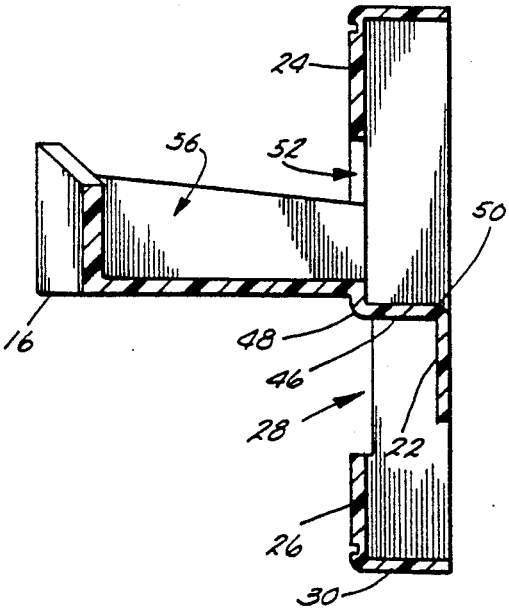
FIG. 6 is a sectional view along section line VI—VI of FIG. 2.

Mounting plate 22 extends between side portions 32 and 34 of perimeter flange 14 across the back of caddy 10 (FIG. 2). Mounting plate 22 is aligned with and spaced rearward of slot 28 (FIGS. 6 and 7). Key-hole shaped apertures 42 and 44 are provided in mounting plate 22 for screw attachment of caddy 10 to a vertical surface (FIG. 2). A horizontally extending web 46 extends between the lower edge 48 of upper plate 24 and the top edge 50 of mounting plate 22 (FIGS. 6 and 7). Web 46 also extends between side portions 32 and 34 of perimeter flange 14 (FIG. 2).

Caddy 10 is economically moldable in a simple two-piece mold for forming the front and rear surfaces of caddy 10, respectively. Apertures 52 and 54, adjacent arms 16 and 18 and channel areas 56 and 58 within arms 16 and 18 accommodate forward extending projections from a rear mold piece (FIGS. 1–3 and 6).

Figure 3:
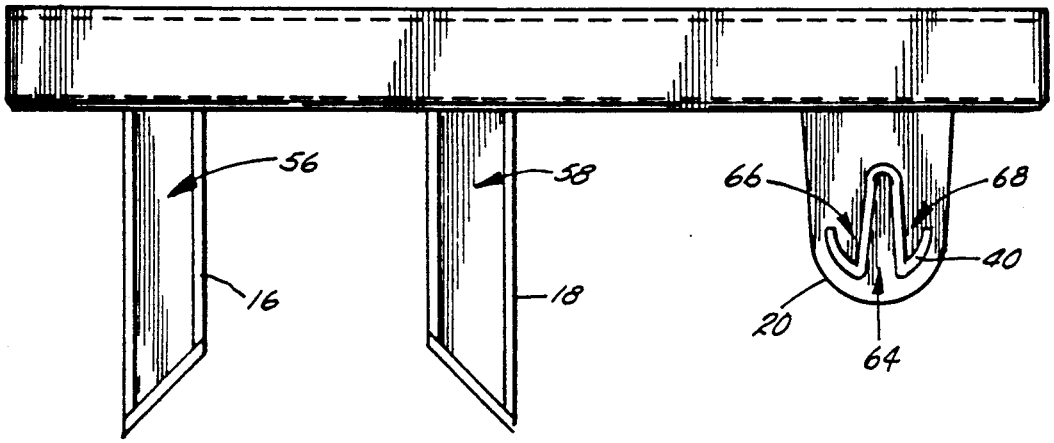
FIG. 3 is a top plan view of the caddy of FIG. 1.
Figure 4:
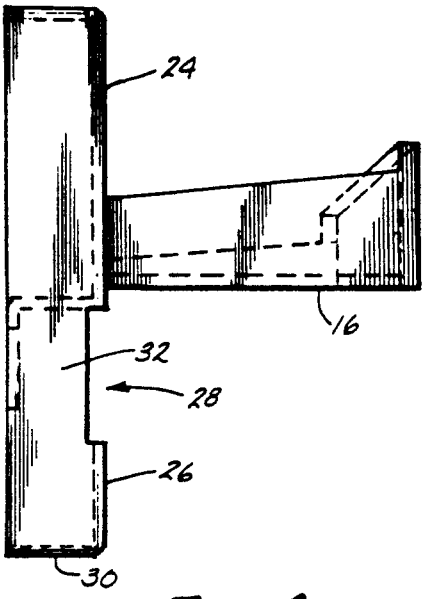
FIG. 4 is a left end elevational view of the caddy of FIG. 1.
Figure 5:
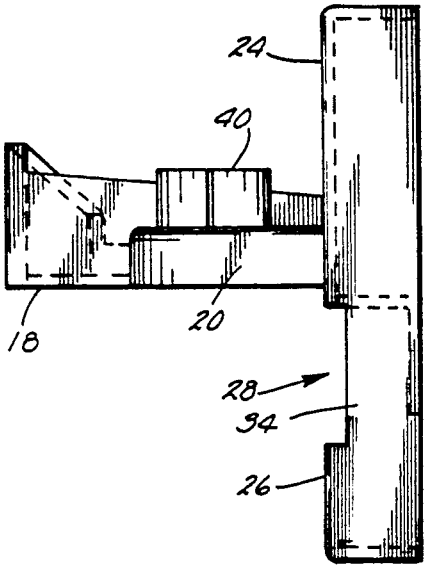
FIG. 5 is a right end elevational view of the caddy of FIG. 1.

Likewise, an aperture 60 is provided adjacent arm 20 in upper plate 24 and a recess 62 is provided in the body of arm 20 to accommodate forward extending projections from a rear mold piece (FIGS. 1, 2 and 7). Further, stud 40, extending from arm 20, is specifically W-shaped in plan view to accommodate molding in a two-piece mold (FIG. 3). Stud 40 has a forward facing opening 64 for receiving a rearward extending projection from a first half of a two-piece mold and rearward facing openings 66 and 68 for receiving corresponding forward extending projections from a second half of a two-piece mold.

The above description is considered that of the preferred embodiment only. Modifications of the invention will occur to those who make or use the invention. Therefore, it is understood that the embodiment shown in the drawings and described above is merely for illustrative purposes and is not intended to limit the scope of the invention, which is defined by the following claims as interpreted according to the principles of patent law, including the doctrine of equivalence.

The embodiments of the invention in which an exclusive property or privilege is claimed are defined as follows:

1. A vacuum and extractor accessories caddy which is moldable in a two-piece mold comprising:

a generally planar face panel;

a perimeter flange circumscribing said face panel, said flange extending to one side of said face panel and having a terminal edge away from said face panel;

a plurality of support arms for supporting at least one cleaning accessory, said arms extending from said face panel in a direction generally opposite to the direction to which said flange extends;

mounting means for mounting said caddy upon a vertical surface;

means defining a slot in said face panel, said slot extending between and defining an upper panel and a lower panel and extending between said perimeter flange on one side of said caddy and said perimeter flange on the opposing side of said caddy; and said lower panel and said perimeter flange adjacent said lower panel defining a tray which is open and accessible through said slot; said tray being open at its back, opposite said front panel, whereby said caddy can be molded in a two-piece mold and whereby the wall on which said caddy is eventually mounted serves as a back wall for said tray.

2. The caddy defined in claim 1 wherein said support arms project from said upper panel.

3. The caddy defined in claim 2 wherein at least one of said support arms extends from said upper panel to a terminal end of said arm and an upward extending stud for receiving and supporting a cleaning tool projects upward from said first arm near said terminal end.

4. The caddy defined in claim 3 wherein said stud is generally W-shaped in top plan view defining two openings facing to one side of said stud and one opening facing opposite thereto, said stud being oriented so that at least one of said openings opens toward said face panel.

5. The caddy defined in claim 3 wherein said mounting means comprises a mounting plate; said plate extends between said perimeter flange on one side of said caddy and said perimeter flange on the opposing side of said caddy; said plate is connected with said perimeter flange at said terminal edge of said perimeter flange; said plate is sized no larger than said slot; and said plate is aligned with and spaced behind said slot.

6. The caddy defined in claim 5 further including a web member connected between said upper panel, said mounting panel, said perimeter flange on one side of said caddy and said perimeter flange on the opposing side of said caddy.

7. The caddy defined in claim 1 wherein at least one of said support arms extends from said upper panel to a terminal end of said arm and an upward extending stud for receiving and supporting a cleaning tool projects upward from said first arm near said terminal end.

8. The caddy defined in claim 7 wherein said stud is generally W-shaped in top plan view defining two openings facing to one side of said stud and one opening facing opposite thereto, said stud being oriented so that at least one of said openings opens toward said face panel.

9. The caddy defined in claim 8 wherein said mounting means comprises a mounting panel; said panel extends between said perimeter flange on one side of said caddy and said perimeter flange on the other side of said caddy; said panel connected with said perimeter flange at said terminal edge of said perimeter flange; said panel is sized no larger than said slot; and said panel is aligned with and spaced behind said slot.

10. The caddy defined in claim 9 further including a web member connected between said upper panel, said mounting panel, said perimeter flange on one side of said caddy and said perimeter flange on the opposing side of said caddy.

11. A vacuum and extractor accessories caddy comprising:

a generally planar face panel;

a perimeter flange circumscribing said face panel and extending to one side of said face panel;

mounting means for mounting said caddy upon a vertical surface;

at least one pair of upwardly opening channel members extending from said face panel in a direction generally opposite to said perimeter flange, defining a pair of support arms for supporting a cleaning accessory;

at least one support member projecting from said face panel in a direction generally opposite to said perimeter flange and having a terminal end away from said face panel; and a stud projecting generally upward from said support member for receiving and supporting a cleaning tool.

12. The caddy defined in claim 11 wherein each said channel member has a terminal end away from said face panel and a flange portion projecting generally upward at said terminal end for retaining a cleaning accessory on said channel members.

13. The caddy defined in claim 12 wherein an aperture is defined in said face panel, interior to each said channel member, for receiving a projecting portion of a mold therethrough so that said caddy may be molded in a two-piece mold.

14. The caddy defined in claim 13 wherein said stud is generally W-shaped in top plan view defining two openings facing to one side of said stud and one opening facing opposite thereto, said stud being oriented so that at least one of said openings opens toward said face panel.

15. The caddy defined in claim 14 wherein an aperture is defined in said face panel adjacent to and above said support member for receiving a projecting portion of a two-piece mold therethrough so that said stud may be molded in a two-piece mold.

16. The caddy defined in claim 15 further including means defining a slot in said face panel, said slot extending between and defining an upper panel and a lower panel and extending between said perimeter flange on one side of said caddy and said perimeter flange on the opposing side of said caddy.

17. The caddy defined in claim 11 wherein said stud is generally W-shaped in top plan view defining two openings facing to one side of said stud and one opening facing opposite thereto, said stud being oriented so that at least one of said openings opens toward said face panel.

18. The caddy defined in claim 17 wherein an aperture is defined in said face panel adjacent to and above said support member for receiving a portion of a two-piece mold therethrough so that said stud may be molded in a two-piece mold.

19. The caddy defined in claim 18 wherein said mounting means comprises a mounting plate; said plate extends between said perimeter flange on one side of said caddy and said perimeter flange on the opposing side of said caddy; said plate is connected with said perimeter flange at said terminal edge of said perimeter flange; said plate is sized no larger than said slot; and said plate is aligned with and spaced behind said slot.

* * * * *